US010053874B2

(12) United States Patent
Mickan et al.

(10) Patent No.: US 10,053,874 B2
(45) Date of Patent: Aug. 21, 2018

(54) ADJUSTABLE SCAFFOLDING

(71) Applicant: Tarsco Construction Corporation, The Woodlands, TX (US)

(72) Inventors: Mark Daniel Mickan, Hockley, TX (US); Christopher Andrew Blinn, Anderson, TX (US); Christopher Ennis Williams, Montgomery, TX (US); Paul Steven Showan, Spring, TX (US)

(73) Assignee: Tarsco Construction Corporation, The Woodlands, TX (US)

( * ) Notice: Subject to any disclaimer, the term of this patent is extended or adjusted under 35 U.S.C. 154(b) by 85 days.

(21) Appl. No.: 15/046,272

(22) Filed: Feb. 17, 2016

(65) Prior Publication Data

US 2016/0237702 A1 Aug. 18, 2016

Related U.S. Application Data

(60) Provisional application No. 62/117,864, filed on Feb. 18, 2015.

(51) Int. Cl.

| | |
|---|---|
| ***E04G 3/20*** | (2006.01) |
| ***E04G 3/24*** | (2006.01) |
| ***E04G 5/06*** | (2006.01) |
| ***E04G 5/04*** | (2006.01) |
| ***E04G 5/14*** | (2006.01) |
| *E04G 1/15* | (2006.01) |

(52) U.S. Cl.

CPC ..... *E04G 3/243* (2013.01); *E04G 3/20* (2013.01); *E04G 3/246* (2013.01); *E04G 5/048* (2013.01); *E04G 5/062* (2013.01); *E04G 5/14* (2013.01); *E04G 2001/155* (2013.01)

(58) Field of Classification Search

CPC ..... E04G 3/243

See application file for complete search history.

(56) References Cited

U.S. PATENT DOCUMENTS

| | | | | | |
|---|---|---|---|---|---|
| 3,289,788 | A | * | 12/1966 | Evans | E04G 1/36 182/128 |
| 3,379,281 | A | * | 4/1968 | Calletti | E04G 21/16 182/113 |
| 3,515,244 | A | * | 6/1970 | Weible | E04G 3/20 182/150 |
| 3,807,529 | A | * | 4/1974 | Reed | B63C 5/02 182/130 |
| 3,825,098 | A | | 7/1974 | Shingler | |

(Continued)

FOREIGN PATENT DOCUMENTS

| | | |
|---|---|---|
| WO | 2013034915 | 3/2013 |

*Primary Examiner* — Alvin C Chin-Shue

(74) *Attorney, Agent, or Firm* — Tumey L.L.P.

(57) ABSTRACT

An adjustable scaffolding that may adjust to the curvature of a structure. The adjustable scaffolding may comprise a main member, pegs, wing platforms, and rails. A method of use may be employed in which the main member is attached to a structure. The pegs may be secured to the main member in any desired orientation to adjust to the curvature of a structure. Wing platforms may be placed over the pegs, allowing a user to walk along the wing platform. Railing is placed within the pegs, allowing the pegs and the railing to secure the wing platform to the main member.

13 Claims, 4 Drawing Sheets

(56) References Cited

U.S. PATENT DOCUMENTS

| | | | | | |
|---|---|---|---|---|---|
| 4,082,161 | A * | 4/1978 | Johnson | E04G 3/24 | 182/142 |
| 4,497,389 | A | 2/1985 | Chin-Shue et al. | | |
| 4,577,727 | A * | 3/1986 | Frei | E04G 11/065 | 182/128 |
| 4,919,230 | A * | 4/1990 | Langer | E04G 1/15 | 182/186.8 |
| 4,949,230 | A * | 8/1990 | Burmeister | F21V 33/0052 | 362/109 |
| 4,971,169 | A | 11/1990 | Fruth | | |
| 5,230,404 | A | 7/1993 | Klein | | |
| 5,568,775 | A * | 10/1996 | Rizzi | A47B 17/065 | 108/64 |
| 5,950,760 | A | 9/1999 | Smith | | |
| 6,722,468 | B2 | 4/2004 | Albano | | |
| 6,761,247 | B2 * | 7/2004 | Wyse | E04G 1/154 | 182/118 |
| 8,595,989 | B1 * | 12/2013 | Greene | E04H 7/065 | 52/182 |
| 9,493,957 | B2 * | 11/2016 | Miller | E04G 3/243 | |
| 2005/0077107 | A1 * | 4/2005 | Libert | E04G 1/15 | 182/119 |
| 2006/0243524 | A1 * | 11/2006 | Jarrell | E04G 5/06 | 182/82 |
| 2013/0341125 | A1 | 12/2013 | Meldner et al. | | |
| 2014/0348619 | A1 * | 11/2014 | Granger | B65B 23/00 | 414/399 |

* cited by examiner

ADJUSTABLE SCAFFOLDING

CROSS-REFERENCE TO RELATED APPLICATIONS

The present application claims priority to U.S. Provisional Application No. 62/117,864, filed Feb. 18, 2015, the entire disclosure of which is incorporated herein by reference.

BACKGROUND

Embodiments relate generally to scaffolding for use in the construction field. More particularly, embodiments relate to scaffolding that may be used to build tanks or other rounded structures.

Current scaffolding is designed to facilitate the construction of straight edged structures. During the building of curved structures, such as large storage tanks, current scaffolding may often be burdensome, inefficient, and hazardous. Current scaffolding uses wooden boards, wire rope, and midrails, which may not allow workers to build scaffolding around the curve of a structure. Additionally, current scaffolding may often be moved repeatedly during construction to conform to various curves in the structure, which may increase time and cost to a construction project. Current scaffolding may also be vulnerable to windy conditions and susceptible to collapse. Traditional methods of scaffolding construction may include bringing in large amounts of extra scaffolding and/or designing and building scaffolding specifically for a particular structure. These methods may be time consuming and costly. In an effort to reduce material, cost, labor, and construction time an adjustable scaffold is needed that may conform to curved structures.

BRIEF DESCRIPTION OF THE DRAWINGS

These drawings illustrate certain aspects of some of the embodiments of the present invention and should not be used to limit or define the invention.

DETAILED DESCRIPTION

Embodiments relate generally to scaffolding for use in the construction field. More particularly, embodiments relate to scaffolding that may be used to build tanks and/or other rounded structures. Advantageously, the scaffolding disclosed herein may reduce the material, cost, labor, construction time associated with scaffolding during the construction of a curved structure and may increase safety and wind stability. An example of adjustable scaffolding may comprise a main member, a platform, and a peg. The main member may further comprise a main platform and a main support, wherein the main platform may further comprise a track cutout. The peg may connect to the main member, holding the platform in place while in use. The adjustable scaffolding may function using a method that may comprise positioning the main member along a structure and connecting the main member to the structure. While connected, the peg may be loosened which may allow the peg to travel along a track cutout to a desired position. Once at the desired position, the peg may be tightened in place along the track cutout. This may position the wing platform along the curvature of a structure.

Figure 1:
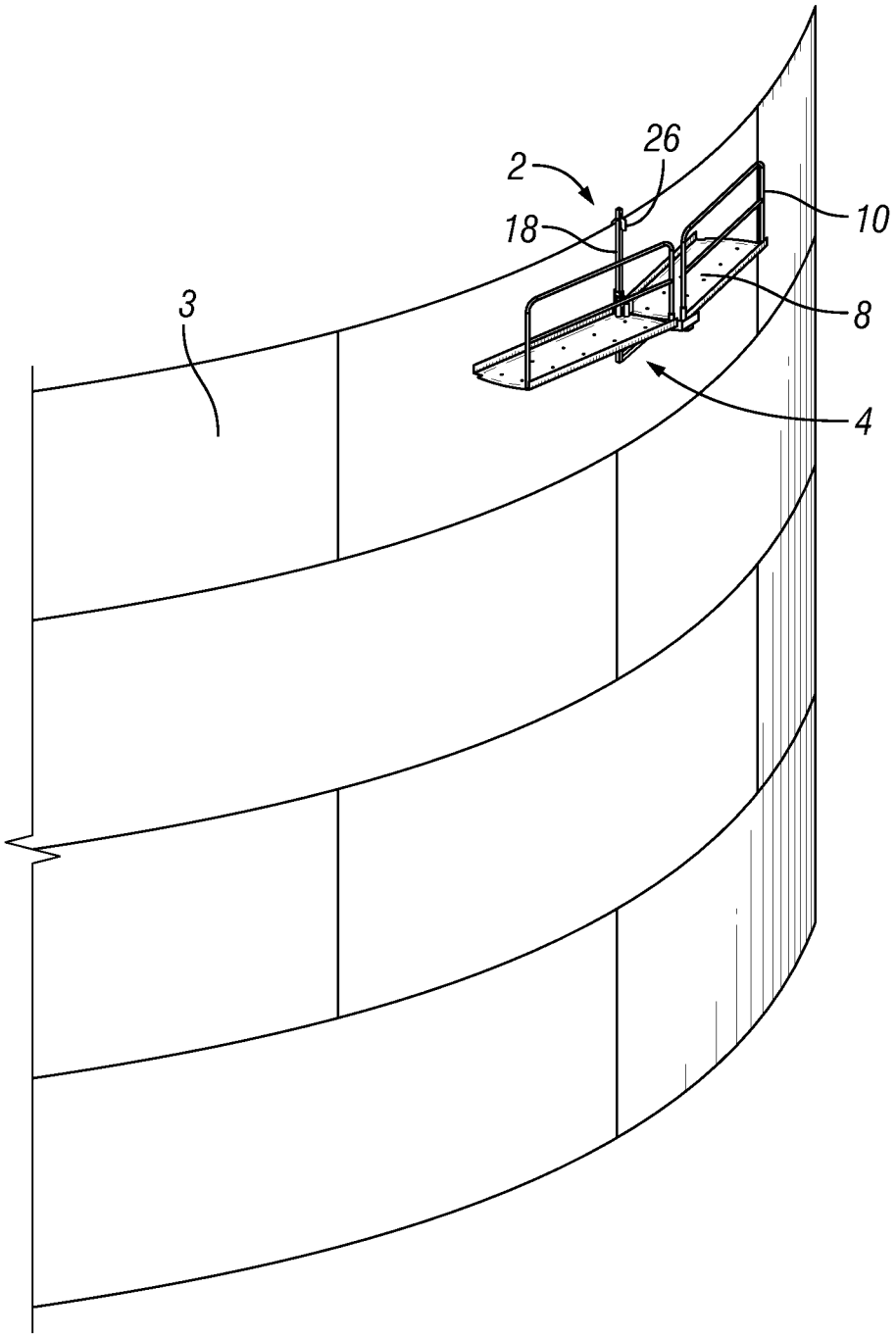
FIG. 1 illustrates an example adjustable scaffolding attached to a curved storage tank.
Figure 4:
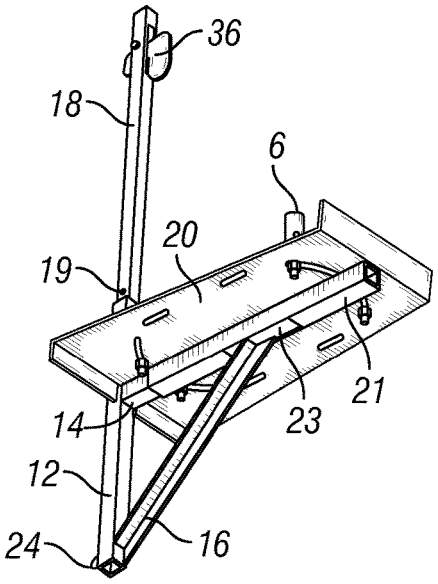
FIG. 4 illustrates a bottom perspective view of the main member of an example adjustable scaffolding.
Figure 5:
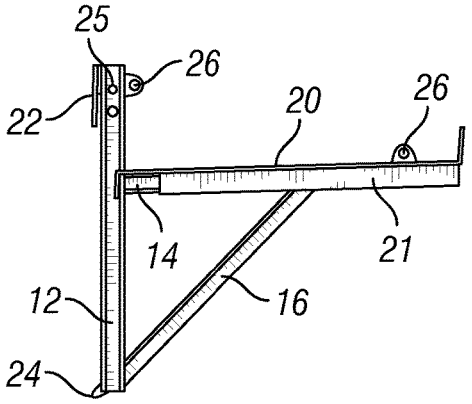
FIG. 5 illustrates a side view of the main member of an example adjustable scaffolding.
Figure 6:
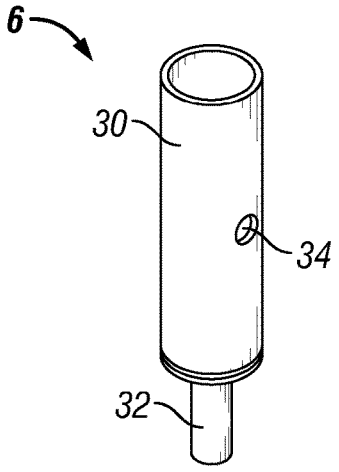
FIG. 6 illustrates a perspective view of a peg of an example adjustable scaffolding.

Embodiments relate generally to adjustable scaffolding. As illustrated in FIG. 1, adjustable scaffolding 2 may be disposed about any location along a structure 3. Specifically, adjustable scaffolding 2 may attach to structure 3 at a location in which material may be being disposed to build and/or alter structure 3. With additional reference to FIG. 2, adjustable scaffolding 2 may comprise a main member 4 and a wing platform 8. In the illustrated embodiment, a pair of win platforms 8 are shown coupled to main member 4. In embodiments, main member 4 may support adjustable scaffolding 2 against structure 3. Main member 4 may attach to structure 3 by any suitable means. Suitable means may include, but are not limited to, welding, using straps, using hooks, using nuts and bolts, and/or any combination thereof. Main member 4, as illustrated in FIGS. 4-6, may comprise any suitable material in which to support adjustable scaffolding 2. Suitable material may be, but is not limited to steel, plastic, galvanized steel, stainless steel, carbon steel, carbon fiber, aluminum, glass fiber, nylon, polyester, and/or any combination thereof. Additionally, main member 4 may comprise a main support 12, a main horizontal brace 14, a main brace 16, an adjustable support arm 18, a main platform 20, a support hook 22, and a standoff 24. In embodiments, main support 12 may be a base structure upon which main horizontal brace 14, main brace 16, adjustable support arm 18, main platform 20, support hook 22, and standoff 24 attach. Main support 12 may be hollow, solid, and/or any combination thereof. Structurally, main support 12 may be circular tubing, square tubing, solid channel, punched channel, half-slotted channel, slotted channel, and/or any combination thereof. Main support 12 may be any suitable length, including about six inches to about forty eight inches, about twelve inches to about forty two inches, about eighteen inches to about thirty six inches, or about twenty four inches to about thirty inches. In embodiments, main horizontal brace 14 may attach to main support 12, which may create a ledge.

As illustrated in FIGS. 4-6, main horizontal brace 14 may attach to main support 12 by any suitable connecter. A suitable connector may be, but is not limited to nuts and bolts, machining, welding, forming, adhesive, screws, and/or any combination thereof. Main horizontal brace 14 may comprise the same material, structure, and length as main support 12. Additionally, main horizontal brace 14 may extend horizontally away from main support 12, which may form a ledge. In embodiments, main horizontal brace 14 may be disposed about any suitable location along main support 12. Main horizontal brace 14 may be disposed about any edge of main support 12. In embodiments, main horizontal brace 14 may be disposed about the center of main support 12, about an end of main support 12, or between each end of main support 12. Specifically, in some embodiments, main support 12 may be located about four inches to about twenty four inches, about eight inches to about twenty inches, about twelve inches to about sixteen inches, or about six inches to about eighteen inches from an end of main support 12. Main horizontal brace 14 may form a structural platform upon which main platform 20 may be disposed.

As illustrated in FIGS. 4-6, main platform 20 may attache to main horizontal brace 14 by any suitable connector. A suitable connector may be, but is not limited to nuts and bolts, machining, welding, forming, adhesive, screws, and/or any combination thereof. In embodiments, main platform 20 may be disposed along the top most edge of main horizontal brace 14. Main horizontal brace 14 may be disposed about the center of main platform 20 and may run the length of main platform 20, which may allow for weight disposed upon main platform 20 to be evenly distributed. Main platform 20 may be made of the same material as main support 12. In embodiments, main platform 20 may be any suitable shape. A suitable shape may be square, rectangular, triangular, polyhedral, and/or any combination thereof. Main platform 20 may have about ninety degree bends at edges of main platform 20, wherein the edges are opposite each other. The edges with bends may be the edge closet to main support 12 and the edge furthest from main support 12. Each bend may add rigidity to main platform 20 and may further act as a safety mechanism, indicating where the end of adjustable scaffolding 2 may be disposed. In embodiments, main platform 20 may further comprise a sleeve 21.

Sleeve 21, as illustrated in FIGS. 5 and 6, may allow main platform 20 to slide along the axis of main horizontal brace 14. This may allow main platform 20 to move further and/or closer to main support 12 as desired. Weight placed upon main platform 20 may prevent main platform 20 from moving along main horizontal brace 14 while in use. Sleeve 21 may connect to main platform 20 by any suitable connecter. A suitable connector may be, but is not limited to nuts and bolts, machining, welding, forming, adhesive, screws, and/or any combination thereof. Sleeve 21 may comprise the same material, structure, and length as main support 12. In embodiments, the structure of sleeve 21 may be slightly larger than main horizontal brace 14, which may allow sleeve 21 to slide over main horizontal brace 14. Sleeve 21 may attach to main platform 20 about the center axis of the bottom of main platform 20 and may run the length of main platform 20. A cutout 23 may dictate the length at which main platform 20 may slide. The length of cutout 23 may allow movement of sleeve 21 along main horizontal brace 14 until cutout 23 contacts main brace 16. Movement along the axial direction of main horizontal brace 14 may be limited by the location of main brace 16. Main brace 16 may attach to main horizontal brace 14 through cutout 23.

As illustrated in FIGS. 4-6, main horizontal brace 14 may be supported by main brace 16. Main brace 16 may comprise the same material, structure, and length of main support 12. Additionally, main brace 16 may structurally comprise angle iron. In embodiments, main brace 16 may attach to main support 12 and main horizontal brace 14 by any suitable connector. A suitable connector may be, but is not limited to, nuts and bolts, machining, welding, forming, adhesive, screws, and/or any combination thereof. Main brace 16 may be disposed at any suitable location along main support 12. In embodiments, main brace 16 may structurally form an angle, as illustrated in FIGS. 5 and 6. Main brace 16 may attach to main support 12 at any suitable location along main support 12. In embodiments, main brace 16 may be disposed at about an end of main support 12 or may be disposed between both ends of main support 12. Specifically, in some embodiments, main brace 16 may attach to main support 12 about four inches to about twenty four inches, about eight inches to about twenty inches, about twelve inches to about sixteen inches, or about six inches to about eighteen inches from an end of main support 12. Main brace 16 may form an angle with main support 12 as main brace 16 traverses from main support 12 to main horizontal support 14. For example, main brace 16 may form a forty five degree angle with main support 12. In embodiments, the angle formed may be between about ten degrees and eighty degrees, about twenty degrees and seventy degrees, about thirty degrees and sixty degrees, about forty degrees to about fifty degrees, about thirty three degrees, about twenty two degrees, or about forty degrees. Main brace 16 may be disposed at about an end of main horizontal brace 14 or may be disposed between both ends of main horizontal brace 14. Specifically, in some embodiments, main brace 16 may attach to main horizontal brace 14 about four inches to about twenty four inches, about eight inches to about twenty inches, about twelve inches to about sixteen inches, or about six inches to about eighteen inches from an end of main horizontal brace 14. An adjustable support arm 18 may further attach to main support 12.

Figure 3:
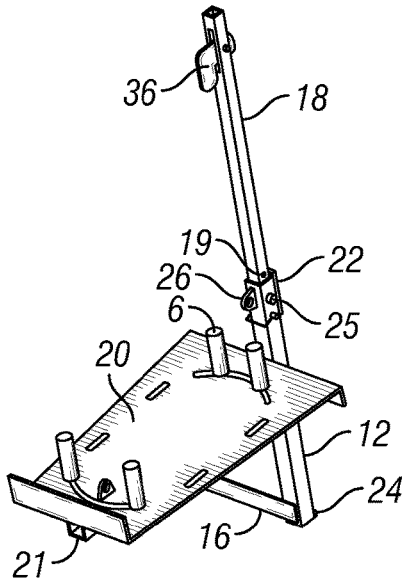
FIG. 3 illustrates a top perspective view of the main member of an example adjustable scaffolding.

Adjustable support arm 18, as illustrated in FIGS. 3-5, may comprise the same material, structure, and length as main support 12. However, adjustable support arm 18 may be any appropriate width and depth to slide within main support 12. In embodiments, adjustable support arm 18 may retract within main support 12. Adjustable support arm 18 may be disposed at the top most end of main support 12. In embodiments, adjustable support arm 18 may further have aligned holes 19 on opposing sides of adjustable support arm 18. Holes 19 may be disposed about the edges of adjustable support arm 18. Specifically, holes 19 may be disposed at about an end of adjustable support arm 18. Additionally, main support 12 may comprise matching holes 25 in two opposing sides of main support 12. As illustrated in FIG. 4, a retaining pin 22 may slide through holes 19 and holes 25 in adjustable support arm 18 and main support 12, respectively. The retaining pin 22 may hold adjustable support arm 18 in place, which may prevent adjustable support arm 18 from moving. In embodiment, retaining pin 22 may be removed, which may allow adjustable support arm 18 to move within main support 12 to another set of holes 19 within adjustable support arm 18. Retaining pin 22 may then be disposed within the aligned holes 19, holding adjustable support arm 18 in place. The movement of adjustable support arm 18 may allow a user to adjust the height of adjustable scaffolding 2. In embodiments, adjustable support arm 18 may further comprise adjustable tab 36.

Figure 2:
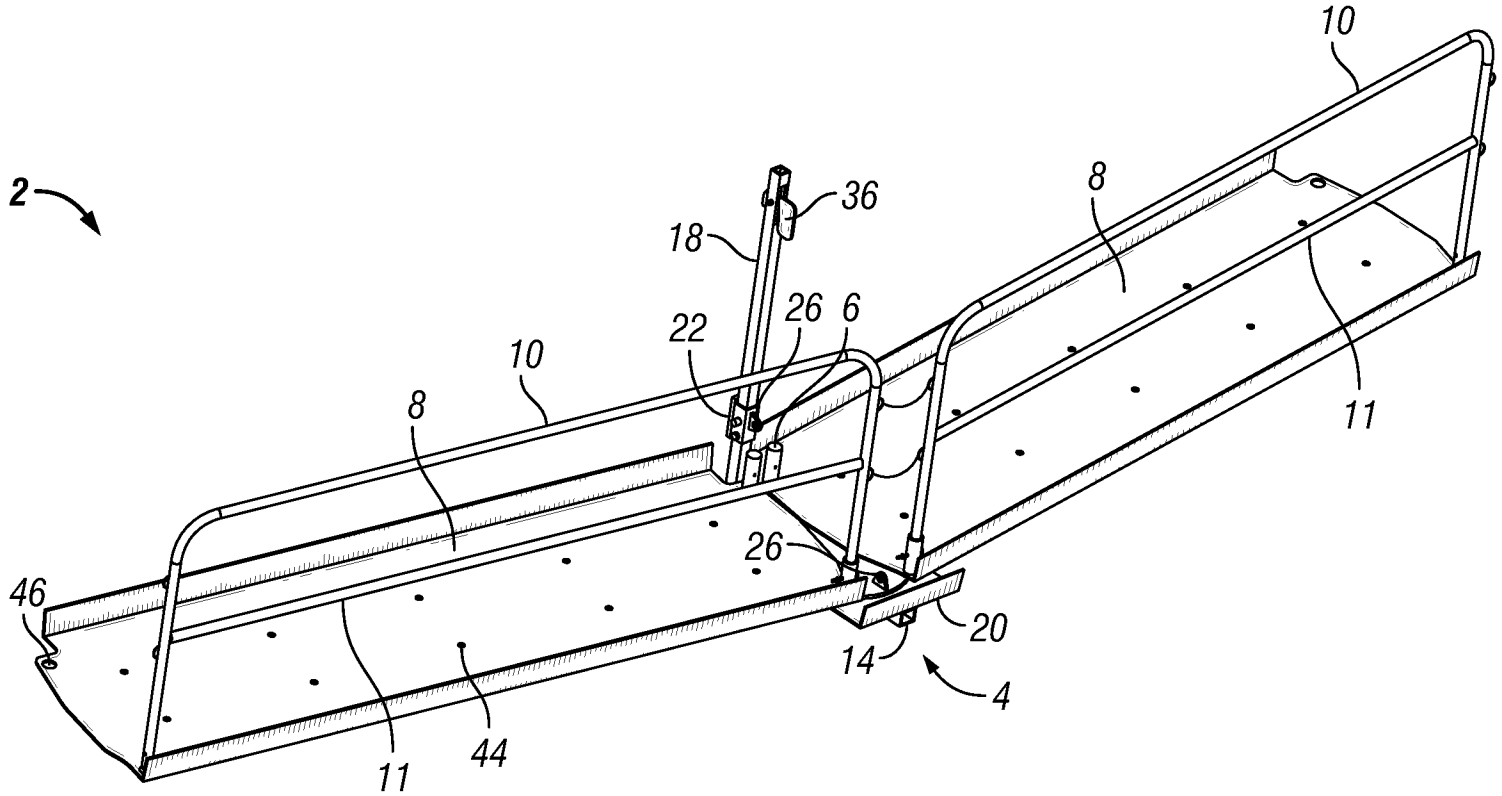
FIG. 2 illustrates the front view of an example adjustable scaffolding.

As illustrated in FIGS. 3-5, adjustable tab 36 may be comprise the same material as main support 12. Adjustable tab 36 may be located at the end of adjustable support arm 18 opposite the end closest to main support 12. In embodiments adjustable tab 36 may comprise a hook at one end and a lobe at the opposing end. Referring to FIG. 2, the lobed end may cause the hook to swing outward, allowing the hook to catch the top of structure 3. The hook may support adjustable scaffolding 2 until adjustable scaffolding may be connected to structure 3. For example, a crane may lift adjustable scaffolding 2 vertically toward the top of structure 3. At the top of the structure the crane may dispose the adjustable scaffolding 2 adjacent to the wall. The crane operator or additional personnel may then maneuver adjustable scaffolding 2 along the top most edge of the wall, allowing for adjustable hook 36 to rest on the top most edge. As illustrated in FIG. 2, adjustable hook 36 supports the weight of adjustable scaffolding 2 until bracket 22 may be welded and/or secured to the structure. Bracket 22 may secure and/or support adjustable scaffolding 2 in place against the structure, allowing for adjustable tab 36 to be removed, which may allow for an additional adjustable scaffolding 2 to be placed upon and/or adjacent to the original adjustable scaffolding 2.

As detailed above, attaching adjustable scaffolding 2 to structure 3 may require bracket 22, best viewed in FIG. 6 to a structure. Bracket 22 may be made of the same material as main support 12. As illustrated in FIG. 6, support bracket 22 may be any shape suitable to attach to a structure. A suitable shape may be, but is not limited to, square, rectangular, circular, polyhedral, and/or any combination thereof. Support bracket 22 may attach to a structure by any suitable means. For example, bracket 22 may hook onto the structure, welded to the structure, strapped to the structure, held to the structure using nuts and bolts, and/or any combination thereof. In embodiments, bracket 22 may attach to main support 12 by any suitable connector. A suitable connector may be, but is not limited to, weld, adhesive, nuts and bolts, screws, machined, formed, and/or any combination thereof. Bracket 22 may be disposed at any suitable edge of main support 12. In embodiment, bracket 22 may be disposed about any end of main support 12 and may be located between each end of main support 12. Specifically, bracket 22 may be disposed at the end of main support 12 opposite the end in which main brace 16 is disposed. Bracket 22 may connect adjustable scaffolding 2 to a structure after lifting adjustable scaffolding 2 into place, which may be accomplished through attachment points 26.

As illustrated in FIGS. 3, 4, and 6, attachment point 26 may be located on main support 12 and main platform 20. Attachment point 26 may allow a lifting mechanism to hoist adjustable scaffolding 2 in position for attachment to a structure. Attachment point 26 may comprise the same material as main support 12. In examples, attachment point 26 may be an eye hook, hook, eye bolt, weldable D-Ring tabs, and/or any combination thereof. In embodiments, attachment point 26 may attach to main support 12 and main platform 20 by and suitable connector. A suitable connector may be, but is not limited to, a weld, adhesive, nuts and bolts, screws, forming, machined, and/or any combination thereof. Attachment points 26 may allow lifting equipment to hoist adjustable scaffolding 2 into position for attachment to a structure. In embodiments, attachment point 26 may attach about the end of main platform 20 opposite the end closest to main support 12. Additionally, attachment point 26 at the end of main support 12 opposite in which main brace 16 is disposed. Specifically, on the edge of main support 12 opposite bracket 22. Adjustable scaffolding 2 may be lifted into place through attachment points 26 and may align itself with the structure through standoff 24.

As illustrated in FIG. 6, standoff 24 may be used to vertically align adjustable scaffolding 2 with structure 3. Standoff 24 may comprise the same material as main support 12. In embodiments, standoff 24 may be any suitable shape. A suitable shape may be, but is not limited to, triangular, circular, square, rectangular, polyhedral, and/or any combination thereof. Standoff 24 may be disposed about the end of main support 12 opposite the end in which bracket 22 may be disposed. Additionally, standoff 24 may be disposed on the edge opposite the end in which main brace 16 is disposed. In embodiments, standoff 24 may exert force upon structure 3, which may move adjustable scaffolding 2 away from structure 3. This may vertically alight adjustable scaffolding 2 with the structure. Vertically aligning adjustable scaffolding 2 with structure 3 may dispose main platform 20 in a perpendicular configuration, which may allow for a level main platform 20 upon which at least one wing platform 8 may be disposed.

As illustrated in FIGS. 4 and 5 main platform 20 may comprise track cutout 28. In embodiments, track cutout 28 may dispose wing platform 8 at an angle in relation to main support 12. Track cutout 28 may form any suitable shape within main platform 20. A suitable shape may be circular, oval, polyhedral, and/or any combination thereof. In embodiments, track cutout 28 may be disposed about the center and/or the edges of main platform 20. Additionally, track cutout 28 may cut through the top and bottom of main platform 20. Track cutout 28 may be a single cutout within main platform 20 or may be a plurality of smaller cutouts within main platform 20, as illustrated in FIGS. 4 and 5. In embodiments, track cutout 28 may allow an operator to rotate wing platform 8 at an angle to main support 12. Track cutout 28 may rotate at least one wing platform 8 through peg 6.

Figure 7:
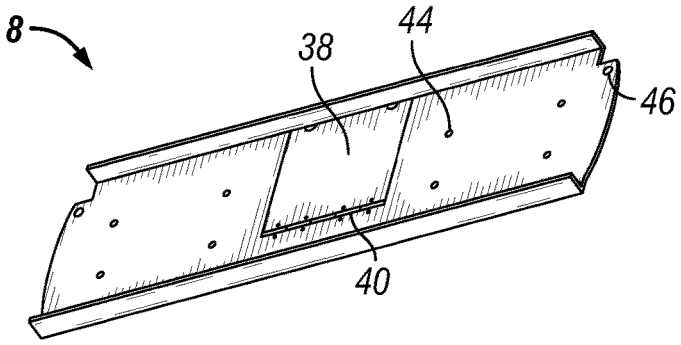
FIG. 7 illustrates a top view of a wing platform of an example adjustable scaffolding.

Peg 6, as illustrated in FIG. 7 may comprise the same material as main support 12. In embodiments, peg 6 may comprise a housing 30, stud 32, and a pin hole 34. Peg 6 may have an opening at one end and may be closed at the opposing end. In examples, housing 30 may be hollow with an internal radius large enough to accommodate rail 10, best seen in FIG. 2. Rail 10 may slide into housing 30 and may come to rest at the closed end of peg 6. Rail 10 may comprise the same material as main support 12. In embodiments, rail 10 may be hollow tubing and/or solid material. In embodiments, rail 10 may be any suitable shape. A suitable shape may be, but is not limited to, circular, oval, square, rectangular, polyhedral, and/or any combination thereof. Additionally, rail 10 may have at least one horizontal run 11. Horizontal runs 11 may prevent a user from falling off wing platform 8. In embodiments, rail 10 may be disposed length wise across both edges of wing platform 8. Rails 10 may be parallel and located on opposing edges. In embodiments, a safety pin, not pictured, may attach rail 10 to peg 6 by inserting a safety pin through pin hole 34. In embodiments, pin hole 34 may be located about any end of housing 30 and/or between the ends of housing 30. Pin hole 34 may align with a pin hole 34 on the opposing side of housing 30. The safety pin may traverse through rail 10, which may further have aligned holes, and both sides of peg 6, which may prevent rail 10 from un-expectantly sliding out of housing 30. Stud 32 may extend from housing 30 at the end of peg 6 opposite the open end of peg 6. In embodiments, stud 32 may attach peg 6, and thus rail 10, to main platform 20. In examples, stud 32 may also be a threaded bolt, which may be threaded into the closed end of housing 30. Stud 32 may fit within track cutout 28 on main platform 20. A nut, not pictured, may be used to tighten peg 6 to platform 20 using threading on stud 32. When loose, peg 6 may traverse along track cutout 28, which may allow a user to dispose peg 6 in a certain position on track cutout 28, which may angle wing platform 8.

Figure 8:
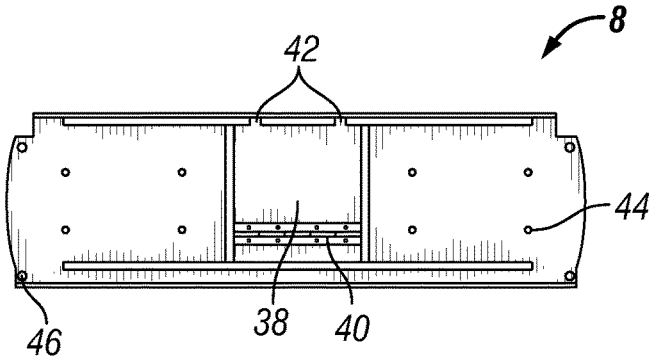
FIG. 8 illustrates a bottom view of a wing platform of an example adjustable scaffolding.

As illustrated in FIGS. 3, 8, and 9, wing platform 8 may connect to main platform 20 through peg 6. Wing platform 8 may comprise the same material as main support 12. As illustrated in FIGS. 8 and 9, wing platform 8 may be any suitable shape. A suitable shape may be rectangular, square, circular, polyhedral, and/or any combination thereof. In examples, wing platform 8 may be about twenty four inches long to about ten feet long, about four feet long to about eight feet long, or about six feet long to about eight feet long. The depth of wing platform 8 may be about twenty four inches to about thirty six inches, about twenty six inches to about thirty inches, or about twenty eight inches to about thirty five inches. Wing platform 8 may have folded edges that may traverse the length of wing platform 8. These edges may increase the rigidity of wing platform 8 and may act as safety indicators, which may indicate to a user where the edges of adjustable scaffolding 2 may be. In embodiments, as illustrated in FIGS. 8 and 9, there may be a door 38 located at any suitable location within wing platform 8. A suitable location for door 38 may be about the ends of wing platform 8 and/or between the ends of wing platform 8. Specifically, door 38 may be located about the center of wing platform 8. During use, door 38 may be opened, allowing a user to maneuver a ladder between a lower adjustable scaffolding 2 and a higher adjustable scaffolding 2. This may allow the user to move between different levels that adjustable scaffolding 2 may have. A hinge 40 may attach door 38 to wing platform 8. Hinge 40 may be disposed at any edge of door 30 and may attach door 30 to the bottom surface of wing platform 8, as illustrated in FIG. 9. During use, chains, not pictured, may attach to the edge of door 38, opposite the edge of hinge 40, to wing platform 8. This may allow door 38 to shut if a user unknowingly walks into the chains. The chains may drop through chain cutouts 42, allowing door 38 to close flush with wing platform 8. Chain cutouts 42 may be disposed along the edge of wing platform 8 in which the chains may be attached. In embodiments, wing platform 8 may further comprise drainage holes 44, which may allow for the elements, such as rain, to pass through wing platform 8. They may prevent elements from collecting upon wing platform 8 and potentially overloading wing platform 8, which may lead to the structural collapse of wing platform 8. Drainage holes 44 may be disposed at any suitable location along wing platform 8. In embodiments drainage holes 44 may be disposed about the edges, about the ends, and/or between the ends of wing platform 8. Additionally, there may be at least one drainage hole 44 within wing platform 8. In embodiments, wing platform 8 may further comprise peg cutouts 46. Peg cutouts 46 may be disposed about the corners of wing platform 8. The inner diameter of peg cutouts 46 may be large enough to allow the outer diameter of peg 6 to pass through. In embodiments, peg cutouts 46 may allow wing platform 8 to attach to main member 4. The height of peg 6 may prevent wing platform 8 from coming off peg 6. Additionally, the safety pin within hole 34 may also hinder wing platform 8 from coming of peg 6.

During use main member 4 may be attached to a structure. A plurality of pegs 6 may be secured to track cutout 28 on main platform 20. Track cutout 28 may allow pegs 6 to maneuver along track cutout 28 to any desired position. Positioning pegs 6 along track cutout 28 may allow for a wing platform 8 to be positioned at any angle in relation to main platform 20. In embodiments tack cutout 28 may be circular in shape. Movement of pegs 6 along this circular shape toward main member 4 may allow for wing platform 8 to angle inward toward the structure in which main member 4 may be attached to. Moving pegs 6 along track cutout 28 away from main member 4 may allow for wing platform 8 to angle outward and away from the structures in which main member 4 may be attached to.

Once pegs 6 are positioned and secured, wing platform 8 may be placed over at least one peg 6. In embodiments, wing platform 8 may be placed over pegs 6 before pegs 6 are secured. Wing platform 8 may move with pegs 6 into a final position before pegs 6 are secured to track cutout 28. Peg cutouts 44 may be located on opposite sides of wing platform 8, this may allow wing platform 8 to attach to a separate and adjacent main member 4. In embodiments, wing platform 8 may be placed upon main member 4 before adjustable metal scaffolding 2 is hoisted into place upon a structure. As illustrated in FIG. 2, the placement of wing platform 8 may allow for rail 10 to be placed and secured within peg 6, as discussed above. Peg 6 and rail 10 may prevent wing platform 8 from coming off main member 4 un-expectantly.

The foregoing figures and discussion are not intended to include all features of the present techniques to accommodate a buyer or seller, or to describe the system, nor is such figures and discussion limiting but exemplary and in the spirit of the present techniques.

What is claimed is:

1. An adjustable scaffolding comprising:

a main member comprising;

a main support;

a main horizontal brace, wherein an end of the main horizontal brace is disposed on the main support, wherein the main horizontal brace extends perpendicular to the main support;

a main brace, wherein a first end of the main brace is disposed about an end of the main support, wherein a second end of the main brace is attached to the main horizontal brace; and a main platform, wherein the main platform comprises:

a track cutout, wherein the track cutout is curved; and a sleeve, wherein the sleeve is disposed on the bottom of the main platform, wherein the sleeve slides axially along the main horizontal brace, wherein the sleeve comprises a cutout, wherein a length of the cutout dictates a length at which the main platform slides along the main horizontal brace, wherein the second end of the main brace attaches to the main horizontal brace through the cutout;

a wing platform, wherein the wing platform attaches to the main platform, wherein the wing platform comprises at least one peg cutout; and at least one peg, wherein the at least one peg comprises a housing, a stud, and a pin hole, wherein the stud of the at least one peg is disposed through the at least one peg cutout and the track cutout, wherein the at least one peg is capable of movement along the track cutout while disposed within the track cutout.

2. The adjustable scaffolding of claim 1, further comprising an adjustable support arm, wherein the adjustable support arm is disposed within the main support.

3. The adjustable scaffolding of claim 2, wherein the main brace forms an angle in relation to the main support.

4. The adjustable scaffolding of claim 2, wherein the adjustable support arm is disposed at the top of the main support and slides in and out of the main support.

5. The adjustable scaffolding of claim 4, wherein a retaining pin slides through the adjustable support arm and the main support to keep the adjustable support arm from moving.

6. The adjustable scaffolding of claim 1, wherein the wing platform comprises a door.

7. The adjustable scaffolding of claim 1, wherein the main brace forms an angle in relation to the main support and the main horizontal brace, and wherein the angle is between 10 degrees and 80 degrees.

8. The adjustable scaffolding of claim 1, further comprise a plurality of said wing platform disposed upon the main platform through the use of said at least one peg.

9. The adjustable scaffolding of claim 8, wherein the plurality of wing platforms are about 24 inches long to about 10 feet long.

10. The adjustable scaffolding of claim 8, wherein the plurality of wing platforms comprise a door.

11. The adjustable scaffolding of claim 8, wherein a rail having at least one horizontal run is disposed on the plurality of wing platforms.

12. The adjustable scaffolding of claim 1, further comprising a standoff, wherein the standoff exerts force upon a structure that moves the adjustable scaffolding away from the structure.

13. The adjustable scaffolding of claim 1, wherein the main member comprises steel, plastic, galvanized steel, stainless steel, carbon steel, carbon fiber, aluminum, glass fiber, nylon, polyester, or combinations thereof.

* * * * *